United States Patent [19]

Groselak et al.

[11] 4,142,310

[45] Mar. 6, 1979

[54] SELF-LOCKING BAGGAGE TAG

[76] Inventors: Robert E. Groselak, 901 S. Owen, Mt. Prospect, Ill. 60056; Albert L. Podgor, 3625 N. Pontiac Ave., Chicago, Ill. 60634

[21] Appl. No.: 786,420

[22] Filed: Apr. 11, 1977

[51] Int. Cl.[2] ..... G09F 3/04

[52] U.S. Cl. ..... 40/21 R

[58] Field of Search ..... 40/21 R, 2 R, 21 C, 40/302, 304; 283/6, 7, 20

[56] References Cited

U.S. PATENT DOCUMENTS

| | | | |
|---|---|---|---|
| 2,183,799 | 12/1939 | Wenk | 40/21 R X |
| 2,811,797 | 11/1957 | Teetor | 40/21 R X |
| 3,321,934 | 5/1967 | Boyd | 40/21 R X |
| 3,550,295 | 12/1970 | Anania | 40/21 R |
| 3,837,101 | 9/1974 | Young | 40/21 R |
| 3,994,085 | 11/1976 | Groselak et al. | 40/21 R |

*Primary Examiner*—John F. Pitrelli

*Attorney, Agent, or Firm*—McWilliams, Mann & Zummer

[57] ABSTRACT

A self-locking baggage tag assembly formed from a single continuous sheet of material including a portion printed for entry of passenger identification information. The assembly is constructed such that the tag may be inserted through a handle of a piece of baggage, folded over the handle and mechanically interlocked such that the passenger identification information is concealed from plain view. The tag assembly includes a detachable claim check. Printed on the exterior portions of the tag assembly are airline, flight and destination information.

1 Claim, 5 Drawing Figures

SELF-LOCKING BAGGAGE TAG

BACKGROUND OF THE INVENTION

Recent airline industry regulations require that there be affixed to the outside of every piece of baggage, a tag or sticker indicating the name and address of the owner of the baggage. Compliance with such requirements has resulted in numerous problems. One example has been the observation of pieces of luggage at an airport by persons who may take advantage of the absence of a traveler from his home. For various other reasons travelers are hesitant to display their name and address readily visible for all to see on the outside of their luggage. Thus it has been desirable to devise a baggage identification tag which is easily attachable to a piece of baggage, which contains all of the required identification information and which provides for concealment of the identification information from unauthorized personnel. One approach to solving this problem is shown in U.S. Pat. No. 3,994,085 issued on Nov. 30, 1976 to the inventors herein.

SUMMARY OF THE INVENTION

The present invention comprises a self-locking baggage identification tag formed from a single continuous sheet of material. The tag includes an identifying claim number and a detachable claim check containing a matching claim number. The tag assembly includes a beveled nose portion, an aperture, self-locking wings and a passenger identification portion. The assembly is constructed such that the passenger or airline employee inserts the nose portion through the handle of a piece of baggage, folds it over and inserts the nose through the aperture past the self-locking wings which secure the assembly against removal. The passenger identification information is thus concealed on the inside of the assembled tag from view by unauthorized personnel.

DESCRIPTION OF THE PREFERRED EMBODIMENT

Figure 1:
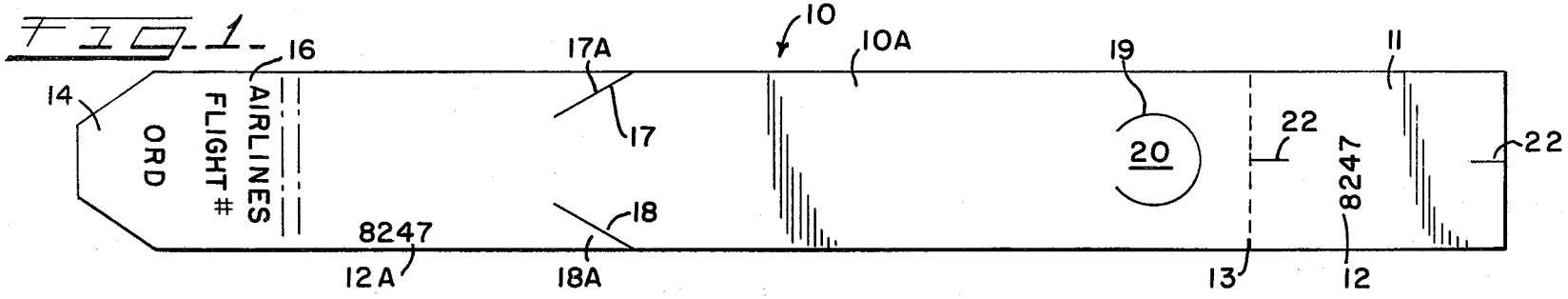
FIG. 1 is a top view of the exterior surface of the baggage tag assembly in its unfolded condition.

Referring now in more detail to the drawings, in which like numerals indicate like parts throughout the several views, FIG. 1 shows what will be referred to as the exterior surface of a baggage tag assembly in its unfolded condition as cut from a single continuous sheet of material. The tag includes an exterior surface 10A and an interior surface 10B. The tag includes a first section 10 which is adapted to be attached to a piece of baggage and a second section 11 comprising a detachable claim check. The claim check 11 contains an identifying claim number 12 and is detachably connected to the first section by means of perforations 13.

The entire baggage tag assembly in the preferred embodiment is formed from TYVEK Spunbonded Olefin, a product of Du Pont. TYVEK Spunbonded Olefin is a family of tough durable sheet products of high-density polyethylene fibers formed by spinning continuous strands of very fine interconnected fibers and then bonding them together with heat and pressure. The resulting product provides a good protecting surface, high opacity and toughness suitable for the tags of the present invention. It has been observed that tags made in accordance with the principles of the invention of TYVEK Spunbonded Olefin material can easily suspend a loaded suitcase weighing up to 75 pounds without tearing or ripping. These properties are essential in order to insure that the tag remains with the baggage even under the most severe handling conditions.

Figure 2:
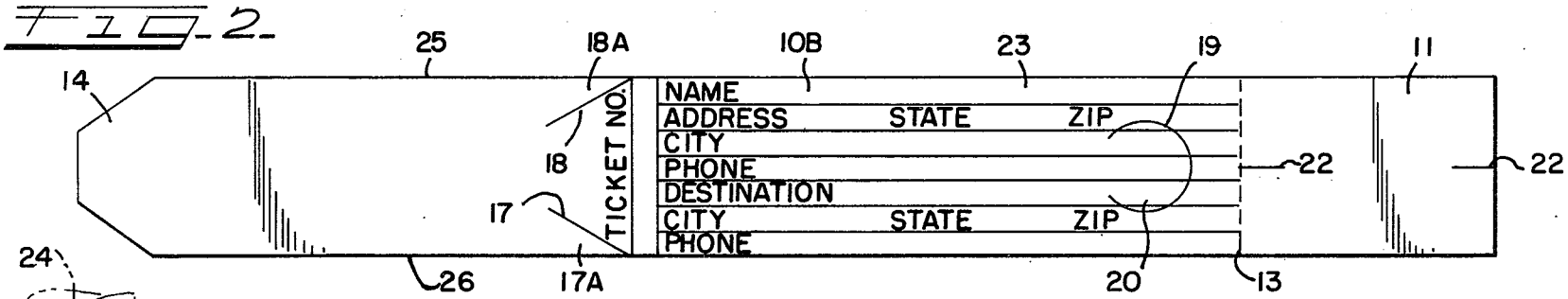
FIG. 2 is a top view of the interior surface of the tag depicted in FIG. 1.

As best shown in FIGS. 1 and 2, the first section 10 consists of a tapered nose section 14. On the exterior surface 10A may be printed information identifying the air carrier, the flight number and the passenger airport destination as indicated at 16. The section 10 also defines a pair of slits 17 and 18 inclined at an angle to the outer edges of the tag. The slits 17 and 18 define a pair of wings 17A and 18A which may be bent out of the plane of the strip of material. The purpose of the slits and corresponding wings is to provide a self-locking feature as will be hereinafter described.

An arcuate slit 19 is provided in the tag which also cooperates to provide the self-locking feature. An arcuate flap 20 is formed inwardly of the slit which may also be bent out of the plane of the strip of material. When the flap is so bent an aperture 21 is defined inwardly of the slit 19.

Also printed on the exterior surface 10A is a baggage claim number 12A which matches the claim number 12 on the detachable claim check portion 11. A pair of slits 22 are defined in the claim check 11 to assist in tearing the same after the check is submitted for reclaiming the baggage. These slits 22 are helpful due to the difficulty in tearing the TYVEK material.

A passenger identification information portion 23 is imprinted on the interior surface 10B for entry of pertinent passenger identification information. The information may include the name, address and phone number of the baggage owner, along with the destination, address and phone number where the traveler can be reached during his stay and the passenger's ticket number.

In operation, when the passenger arrives at the airport check in counter, either he or an airline employee will fill in the required passenger identification information in portion 23 of the baggage tag. The tag assemblies can be provided color coded, if desired, with airline and destination identification already imprinted on one of the exterior surfaces of the cover members. The flight number is then entered on the tag. When all of the required information has been completed, the detachable claim check 11 is removed from the tag assembly and is given to the baggage owner. The nose 14 of the tag assembly is then inserted through a handle 24 of the baggage to be checked with the interior surface 10B facing upward. Next the nose 14 is folded over the baggage handle 24 and bent around such that the nose portion 14 is adjacent to the flap 20.

Pressure is then applied to the edges of the nose portion 14, as for example 25 and 26 to urge the edges to roll inwardly toward the center. This rolling action is facilitated by the slits 17 and 18. With the edges of the nose 14 rolled inwardly toward the center such that the nose, instead of being a flat sheet, assumes a horseshoe shape, the tapered end is pushed through the slit 19 displacing the flap 20 upwardly out of the plane of the strip.

Figure 3:
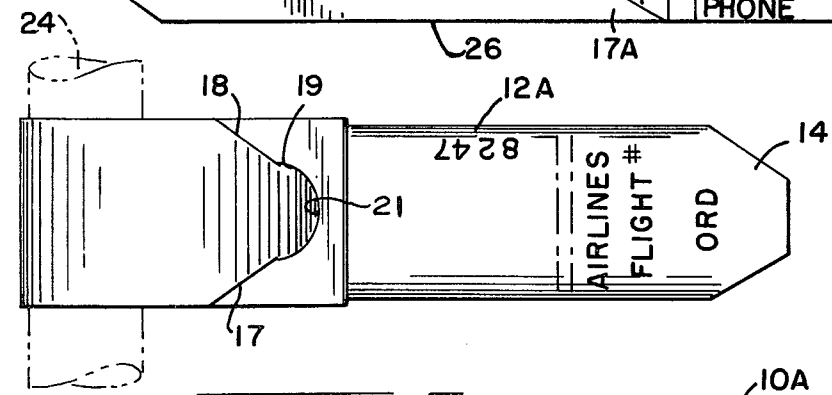
FIG. 3 is a top view of the baggage tag in a folded and operative condition.
Figure 5:
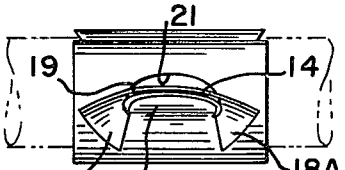
FIG. 5 is an end view of the tag depicted in FIG. 3.
Figure 4:
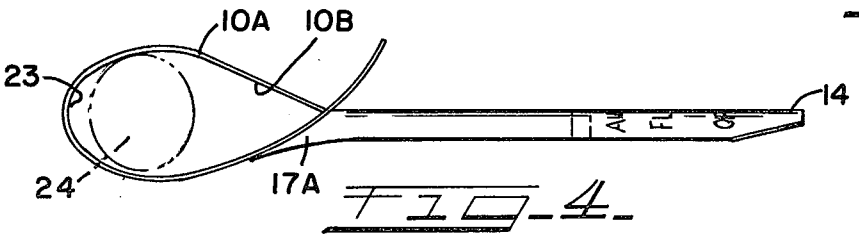
FIG. 4 is a side view of the tag depicted in FIG. 3.

The lead end of the nose portion is then grasped on the side from which it protrudes and is pulled through the slit 19 until the wings 17A and 18A have completely passed through the slit 19. The tension applied to the nose 14 can then be released and the wings 17A and 18A will lie along the surface 10A as best illustrated in FIGS. 3 and 4. The pressure exerted by the wings will cause the end of the tag nearest the slit 19 to become somewhat concave in cross-section. The wings themselves will become bent out of the plane of the nose 14 to lie along the surface 10A and to act as a locking mechanism securing the tag assembly around the handle.

As can be seen in FIGS. 3 and 4 the passenger identification portion 23 faces inwardly and is folded around the handle 21 such that the information is concealed from plain view.

If, for any reason, a piece of baggage becomes misdirected, authorized airline personnel may expose the passenger information portion by pulling on the nose 14, bending the wings 17A and 18A inwardly and passing the wings and nose back through the slit 19. An inspection of the passenger identification information will enable airline personnel to contact the baggage owner either at his home address or at his destination. Once this has been accomplished the tag may again be affixed to the baggage handle as previously described.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A self-locking baggage tag assembly formed from a single continuous sheet of tough durable high density polyethylene material including bonded plastic fibers such as spunbonded olefin, a first section having an exterior surface and an interior surface adapted to be attached to a piece of baggage including a claim number on the first section and a matching number on a second section, said first section including a tapered nose section, an aperture defined in said first section and destination and travel identification information printed on an exterior surface of said first section, self-locking means operable when said nose section has been inserted through said aperture to retard removal of said nose from said aperture, said self-locking means including a pair of wings formed in said first section by a pair of slits each inclined at an angle to the linear axis of said sheet of material, each slit extending inwardly from an edge of said tag assembly and a passenger identification portion disposed between said nose portion and said aperture printed on said interior surface to provide for entry of pertinent passenger identification information, a flap member initially disposed within said aperture but adapted to be bent out of the plane of said sheet to expose said aperture, the second claim check section being detachably connected to said first section whereby when said tag assembly is secured in place around the handle of a piece of baggage the passenger identification information is concealed from plain view, and at least one slit in said second section extending across a portion thereof.

* * * * *